US007886470B1

(12) United States Patent
Doiron

(10) Patent No.: US 7,886,470 B1
(45) Date of Patent: Feb. 15, 2011

(54) BOLT ASSEMBLY FOR A FIREARM

(76) Inventor: Gerald J. Doiron, 1098 Silver Lakes Blvd. #357, Naples, FL (US) 34114

( * ) Notice: Subject to any disclaimer, the term of this patent is extended or adjusted under 35 U.S.C. 154(b) by 572 days.

(21) Appl. No.: 12/078,229

(22) Filed: Mar. 28, 2008

Related U.S. Application Data

(60) Provisional application No. 61/005,547, filed on Dec. 6, 2007, provisional application No. 61/005,762, filed on Dec. 7, 2007.

(51) Int. Cl.
*F41A 3/00* (2006.01)

(52) U.S. Cl. ..... 42/69.02; 42/16; 42/19; 89/180; 89/185

(58) Field of Classification Search ..... 42/69.02, 42/16, 19; 89/180, 185
See application file for complete search history.

(56) References Cited

U.S. PATENT DOCUMENTS

| | | | |
|---|---|---|---|
| 1,081,983 | A | 12/1913 | Pedersen |
| 1,096,679 | A | 5/1914 | Chronis |
| 1,472,126 | A | 7/1918 | Kewish |
| 1,603,684 | A | 9/1919 | Garand |
| 1,563,751 | A | 5/1924 | Kewish |
| 1,502,676 | A | 7/1924 | Kewish |
| 1,587,003 | A | 6/1926 | Kewish |
| 1,696,537 | A | 4/1927 | Kewish |
| 1,780,521 | A | 12/1928 | Garand |
| 1,892,141 | A | 4/1930 | Garand |
| 1,993,887 | A | 4/1932 | Kewish |
| 2,090,656 | A | 8/1937 | Williams |
| 2,370,189 | A | 2/1945 | Penney |
| 2,397,963 | A | 4/1946 | Harvey |
| 2,537,443 | A | 1/1951 | Cerrella |
| 2,774,283 | A | 6/1954 | Harvey |
| 2,951,424 | A | 9/1960 | Stoner |
| 2,785,605 | A | 4/1962 | Jourdat |
| 3,507,187 | A | 4/1970 | Maillard |
| 3,855,900 | A | 12/1974 | Barr et al. |
| 3,877,375 | A | 4/1975 | Barr |
| 4,505,182 | A | 3/1985 | Sullivan |
| 5,351,598 | A | 10/1994 | Schuetz |

(Continued)

OTHER PUBLICATIONS

Hatcher, Julian S. Hatcher's Notebook, pp. 62-66. Stackpole Books, Harrisburg, PA, 1962.

(Continued)

*Primary Examiner*—J. Woodrow Eldred
(74) *Attorney, Agent, or Firm*—Maier & Maier, PLLC

(57) ABSTRACT

A method of assembling a firearm is provided. The method includes providing a bolt assembly that includes a bolt carrier that includes a cammed slot and a first passage, a bolt member slidably coupled to the bolt carrier and positioned within the first passage, the bolt member includes at least one aperture and a second passage, a piston member slidably coupled to the bolt member and positioned within the second passage, the piston member includes an elongated slot and a third passage, wherein the elongated slot includes a first length, and a cam pin slidably coupled to at least one of the bolt carrier, the bolt member and the piston member, the cam pin includes a fourth passage; and coupling the bolt assembly within a cavity of the firearm such that the bolt assembly is slidably coupled to an upper receiver of the firearm.

20 Claims, 5 Drawing Sheets

U.S. PATENT DOCUMENTS

| | | | | |
|---|---|---|---|---|
| 5,448,940 | A | 9/1995 | Schuetz et al. | |
| 6,182,389 | B1 * | 2/2001 | Lewis | 42/16 |
| 6,240,670 | B1 * | 6/2001 | Findlay | 42/70.08 |
| 6,508,025 | B1 * | 1/2003 | Du Plessis | 42/16 |
| 6,609,319 | B1 * | 8/2003 | Olson | 42/16 |
| 6,971,202 | B2 | 12/2005 | Bender | |
| 7,165,496 | B2 | 1/2007 | Reynolds | |
| 2006/0112604 | A1 | 6/2006 | Stone | |
| 2006/0143966 | A1 | 7/2006 | Reynolds et al. | |
| 2009/0049730 | A1 * | 2/2009 | Caulley | 42/69.02 |

OTHER PUBLICATIONS

Website: Springfield Armory Museum—Collection Record. http://www.rediscov.com/spring/VFPCGI.exe?IDCFile=/spring/DETAILS.IDC,SPECIFIC=333,DATABASE=objects.

Website: "The Gun Zone—John C. Garand" http://www.thegunzone.com/johngarand.html Apr. 3, 2007.

Website: The US M1 Garand Rifle http://gunsworld.com/m1m14/m1_hist_us.htm May 17, 2004.

* cited by examiner

30°
30°

BOLT ASSEMBLY FOR A FIREARM

CROSS-REFERENCE TO RELATED APPLICATIONS

This application claims priority to U.S. Provisional Application Ser. No. 61/005,547, filed Dec. 6, 2007 and U.S. Provisional Application Ser. No. 61/005,762, filed Dec. 7, 2007, the entire contents of each are hereby incorporated by reference.

BACKGROUND OF THE INVENTION

This application relates generally to firearms, and more particularly, to firearms that utilize bolt-locking firing technologies for firing center-fire cartridges.

In at least some known automatic and semi-automatic firearms, a cartridge is ejected from the firearm using a portion of the propellant gas generated by the cartridge during ignition. In some known gas-operated firearms, a portion of the propellant gas is channeled from a rifle barrel to an ejection mechanism to actuate a bolt assembly. Specifically, an amount of propellant gas is channeled through a gas port defined within the barrel to a gas tube or a piston and cylinder arrangement. The gas is then converted to kinetic energy and transferred to the bolt assembly, causing the bolt assembly to move rearward. As a result, the bolt assembly is unlocked from the barrel and the spent cartridge is ejected from the chamber. Once the spent cartridge is ejected, a new cartridge is loaded into the chamber. During operation of such systems, propellant gas residue may build-up, or foul, the bolt assembly components. Such fouling may increase the likelihood of misfires or gun-jams.

In another known embodiment, the propellant gases generated by the cartridge facilitates actuating the bolt assembly by utilizing a blowback method. In such an embodiment, the bolt assembly is not locked to the barrel. Rather, a biasing mechanism applies a force to the bolt assembly such that the bolt assembly is coupled to the barrel. During operation, the propellant gases overcome the biasing force and facilitate moving the bolt assembly rearward, or blowing the bolt assembly back, which facilitates ejecting the spent cartridge from the chamber and reloading a new cartridge.

Such gas-operated and blowback systems may facilitate fouling internal firearm components such as the bolt assembly, which facilitates increasing the likelihood of misfires and gun-jams. As such, a user may be required to spend additional time disassembling, cleaning and reassembling the firearm.

BRIEF DESCRIPTION OF THE INVENTION

In one exemplary embodiment, a method of assembling a firearm is provided. The method includes providing a bolt assembly that includes a bolt carrier that includes a cammed slot and a first passage, a bolt member slidably coupled to the bolt carrier and positioned within the first passage, the bolt member includes at least one aperture and a second passage, a piston member slidably coupled to the bolt member and positioned within the second passage, the piston member includes an elongated slot and a third passage, wherein the elongated slot includes a first length, and a cam pin slidably coupled to at least one of the bolt carrier, the bolt member and the piston member, the cam pin includes a fourth passage; and coupling the bolt assembly within a cavity of the firearm such that the bolt assembly is slidably coupled to an upper receiver of the firearm.

In another exemplary embodiment, a bolt assembly is provided. The bolt assembly includes a bolt carrier that includes a cammed slot and a first passage; a bolt member slidably coupled to the bolt carrier and positioned within the first passage, the bolt member includes at least one aperture and a second passage; a piston member slidably coupled to the bolt member and positioned within the second passage, the piston member includes a third passage and an elongated slot that includes a first length; and a cam pin slidably coupled to at least one of the bolt carrier, the bolt member and the piston member, the cam pin includes a fourth passage.

In yet another exemplary embodiment, a firearm is provided. The firearm includes an upper receiver includes a cavity defined therein; a barrel coupled to the upper receiver; a lower receiver coupled to the upper receiver; and a bolt assembly slidably coupled to upper receiver and positioned within the cavity, the bolt assembly including a bolt carrier that includes a cammed slot and a first passage; a bolt member slidably coupled to the bolt carrier and positioned within the first passage, the bolt member includes at least one aperture and a second passage; a piston member slidably coupled to the bolt member and positioned within the second passage, the piston member includes a third passage and an elongated slot that includes a first length; and a cam pin slidably coupled to at least one of the bolt carrier, the bolt member and the piston member, the cam pin includes a fourth passage.

BRIEF DESCRIPTION OF THE DRAWINGS

Advantages of embodiments of the present invention will be apparent from the following detailed description of the exemplary embodiments. The following detailed description should be considered in conjunction with the accompanying figures in which.

DETAILED DESCRIPTION OF THE INVENTION

Aspects of the present invention are disclosed in the following description and related figures directed to specific embodiments of the invention. Those skilled in the art will recognize that alternate embodiments may be devised without departing from the spirit or the scope of the claims. Additionally, well-known elements of exemplary embodiments of the invention will not be described in detail or will be omitted so as not to obscure the relevant details of the invention.

As used herein, the word "exemplary" means "serving as an example, instance or illustration." The embodiments described herein are not limiting, but rather are exemplary only. It should be understood that the described embodiment are not necessarily to be construed as preferred or advantageous over other embodiments. Moreover, the terms "embodiments of the invention", "embodiments" or "invention" do not require that all embodiments of the invention include the discussed feature, advantage or mode of operation.

Figure 1:
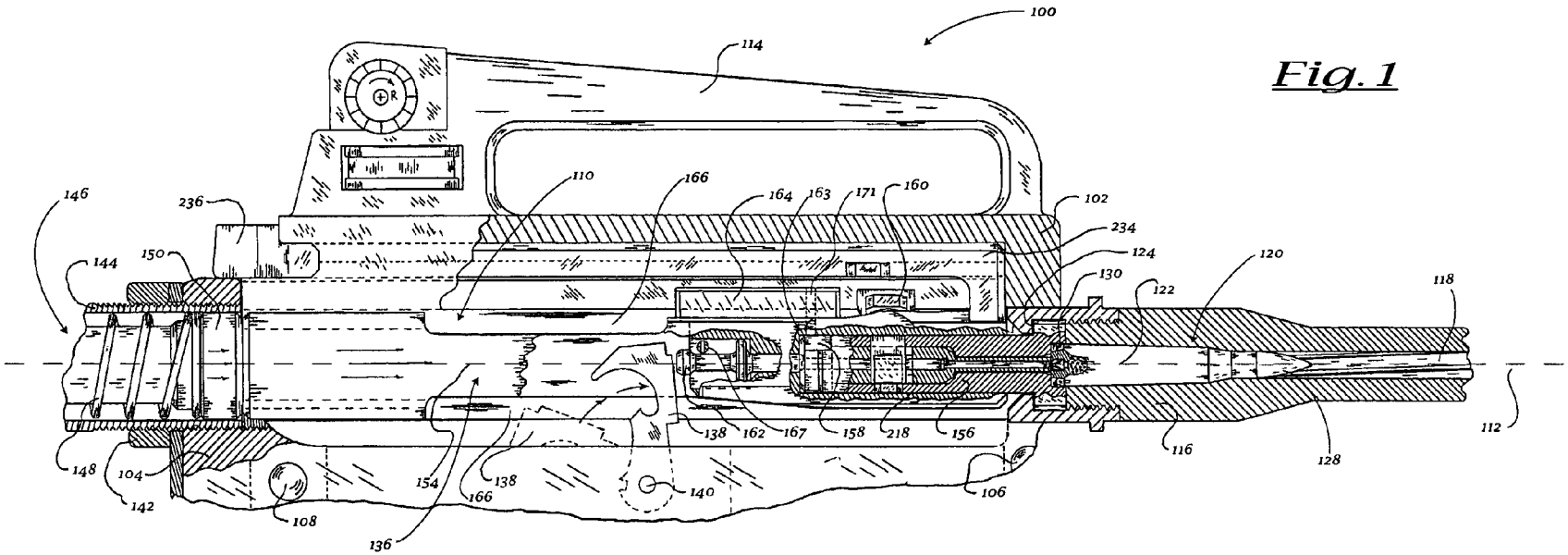
FIG. 1 is a cross-sectional side view of a firearm.

FIG. 1 is cross-sectional side view of a firearm 100. In the exemplary embodiment, firearm 100 may be a rifle such as, but not limited to, an AR-15 or an M-16. In another embodiment, firearm 100 may be any type of firearm that utilizes center-fire cartridges. In yet another embodiment, firearm 100 may be any type of bolt-locked or locked-breach autoloading firearm. In the exemplary embodiment, firearm 100 may include an upper receiver 102 and a lower receiver 104, wherein upper receiver 102 is coupled to lower receiver 104 using a pivot pin 106 and a takedown pin 108. Upper receiver 102 may include a cavity 110 defined therein that includes a firearm centerline axis 112. Moreover, upper receiver 102 may include a handle 114 that extends away from upper receiver 102 to facilitate carrying firearm 100. A bolt assembly 136 may be slidably coupled to upper receiver 102 and positioned within cavity 110 such that bolt assembly 136 may slide along firearm centerline axis 112. Moreover, a barrel 116 may be coupled to upper receiver 102 and may include a rifle bore 118 defined therein that extends an axial length of barrel 116. Rifle bore 118 may include a centerline axis (not shown) that is substantially coaxial with firearm centerline axis 112. Moreover, rifle bore 118 may include a chamber 120 that facilitates housing a cartridge 122 therein. Moreover, barrel 116 may include a plurality of barrel locking lugs 124 that extends substantially radially inward from barrel 116. In the exemplary embodiment, cartridge 122 may be a center-fire cartridge that includes a casing 126 that includes a rim 127. Moreover, cartridge 122 may include a projectile 128 coupled thereto and a primer 130 slidably coupled to casing 126.

Lower receiver 104 may include a trigger assembly (not shown) that includes a hammer 138, which may be pivotably coupled to lower receiver 104 using a hammer pivot pin 140. Moreover, lower receiver 104 may also include a buffer tube retainer 142 that is coupled thereto and may include a buffer tube 144 coupled therein. In one embodiment, buffer tube retainer 142 may be coupled within a buttstock (not shown). A buffer assembly 146 may be slidably coupled to buffer tube 144 and positioned therein. Buffer assembly 146 may include a biasing member 148 that is coupled to a buffer body member 150. Specifically, buffer assembly 146 facilitates applying a biasing force to bolt assembly 136 to facilitate sliding bolt assembly 136 towards barrel 116 along firearm centerline axis 112 to facilitate locking bolt assembly 136 to barrel 116, as described in more detail below. In the exemplary embodiment, buffer assembly 146 may apply between about 7 pounds of force to about 11 pounds of force to bolt assembly 136. More specifically, buffer assembly 146 may apply between about 8 pounds of force to about 10 pounds of force to bolt assembly 136. Even more specifically, buffer assembly 146 may apply about 9 pounds of force to bolt assembly 136. In alternative embodiments of center-fire cartridge firearms 100, the weight of the bolt assemblies may differ compared to the weight of exemplary bolt assembly 136, as a result, buffer assembly 146 may apply any amount of force to bolt assembly 136 that enables firearm 100 to function as described herein.

In the exemplary embodiment, bolt assembly 136 may include a bolt carrier 154, a bolt 156, a piston 158, a cam pin 160 and a firing pin 162. Bolt carrier 154 may be sized and shaped to slidably couple to upper receiver 102 and may be positioned within cavity 110. Moreover, bolt carrier 154 may include a bolt passage 163 defined therein that extends the axial length of bolt carrier 154. Specifically, bolt 156 may be housed within bolt carrier 154, and more specifically, bolt passage 163. A bolt key 164 may extend radially away from bolt carrier 154 to facilitate orientating bolt carrier 154 within cavity 110. Moreover, bolt carrier 154 may include at least one vent hole 171 defined therein that extends between bolt passage 163 and an area outside bolt carrier 154, such that bolt passage 163 and the area outside bolt carrier 154 are coupled in flow communication. Specifically, vent hole 171 facilitates channeling air between bolt passage 163 and the area outside bolt carrier 163 to facilitate preventing the formation of either an amount of compressed air or a vacuum between piston 158 and bolt carrier 154. Further, bolt carrier 154 may include at least one cutout 166 that enables hammer 138 to contact firing pin 162 during operation of firearm 100, as described in more detail below. Moreover, bolt carrier 154 may include at least one retaining pin 167 slidably coupled therein that facilitates retaining firing pin 162 within bolt 156. Bolt carrier 154 may also include a cammed slot 168 (shown in FIG. 9) that enables cam pin 160 to be inserted through bolt carrier 154, and more specifically, through bolt 156 and piston 158.

Cammed slot 168 may include a non-cammed portion 169 that is positioned adjacent a cammed portion 170 of cammed slot 168. More specifically, non-cammed portion 169 may be oriented substantially parallel to firearm centerline axis 112 and sized to facilitate moving bolt carrier 154 rearward between about 0.115 inches to about 0.125 inches, more specifically between about 0.117 inches to about 0.120 inches, and even more specifically about 0.119 inches before cam pin 160 contacts cammed portion 170, as described in more detail below. Moreover, cammed slot 168 facilitates rotating bolt 156 between a first, or unlocked, position and a second, or locked, position, as described in more detail below. In alternative embodiments of center-fire cartridge firearms 100, the weight of the bolt assemblies may differ compared to the weight of the exemplary bolt assembly 136. As a result, in such alternative embodiments, non-cammed portion 169 may be sized to any length depending on the different weights of the alternative embodiments of the bolt assemblies to facilitate moving the bolt carrier rearward any distance that enables firearm 100 to function as described herein.

Figures 2A, 2B, 2C, 2D, 3A, 3B, 3C, 3D, 3E, 4, 5A, 5B:
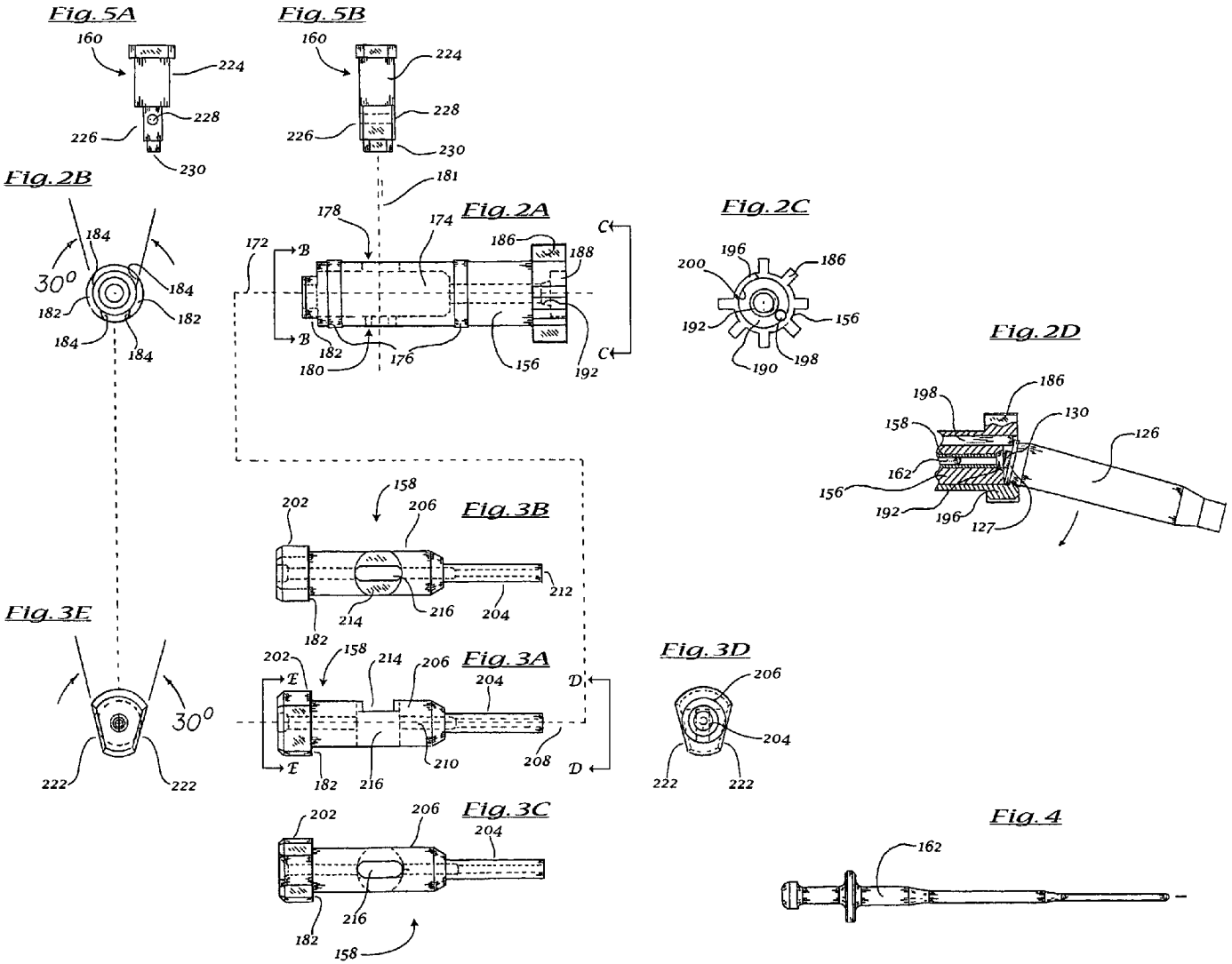
FIG. 2A is a side view of a bolt that may be used in the firearm shown in FIG. 1.
FIGS. 2B and 2C, respectively, are axial end views of the bolt shown in FIG. 2A.
FIG. 2D is a cross-sectional side view of the bolt shown in FIG. 2A.
FIGS. 3A, 3B and 3C are a side view, a top view and a bottom view, respectively, of a piston that may be used in the firearm shown in FIG. 1.
FIGS. 3D and 3E, respectively, are axial end views of the piston shown in FIGS. 3A, 3B and 3C.
FIG. 4 is a side view of a firing pin that may be used in the firearm shown in FIG. 1.
FIG. 5A is an end view of a cam pin that may be used in the firearm shown in FIG. 1.
FIG. 5B is a side view of the cam pin shown in FIG. 5A.

FIGS. 2A-2D represent various views of bolt 156. FIG. 2A is a side view of bolt 156. FIG. 2B is an axial end view of bolt 156 taken along line B-B. FIG. 2C is an axial end view of bolt 156 taken along line C-C. FIG. 2D is a cross-sectional side view of bolt 156. In the exemplary embodiment, bolt 156 may be substantially cylindrically-shaped and include a bolt centerline axis 172, which is substantially coaxial with firearm centerline axis 112. In another embodiment, bolt 156 may be any shape that enables firearm 100 to function as described herein. Bolt 156 may also include a piston passage 174 defined therein that extends the axial length of bolt 156. Specifically, in the exemplary embodiment, piston passage 174 may be sized and shaped to house piston 158 therein, such that piston 158 is slidably coupled to bolt 156. In the exemplary embodiment, bolt 156 may also include a plurality of annular bearing surfaces 176 that each extend radially away from the outer surface of bolt 156 and facilitate preventing fouling within bolt assembly 136.

Bolt 156 may also include a first aperture 178 and a second aperture 180 defined therein. Specifically, first aperture 178 may be substantially circular-shaped and second aperture 180 may be substantially rectangular-shaped. Alternatively, first aperture 178 and second aperture 180 may include any shape that enables firearm 100 to function as described herein. First aperture 178 may include a first aperture axis 181 that extends through the center of first aperture 178 and is substantially perpendicular to bolt centerline axis 172. Moreover, first aperture 178 may be positioned opposite second aperture 180 on bolt 156. In the exemplary embodiment, first and second apertures 178 and 180 are sized and oriented such that cam pin 160 may be inserted therethrough to facilitate removably coupling cam pin 160 to bolt 156, as described in more detail below.

In the exemplary embodiment, bolt 156 may also include a plurality of flanges 182 that each extend substantially axially away therefrom at a first end of bolt 156. Specifically, one flange 182 may be positioned substantially opposite another flange 182, as shown in FIG. 2B. Moreover, each flange 182 may include at least one inner surface 184 that is oriented at a first angle measured with respect to first aperture axis 181. In the exemplary embodiment, the first angle may be about 30°. In another embodiment, the first angle may be oriented at any angle that enables firearm 100 to function as described herein. Specifically, each flange 182, and more specifically, each flange inner surface 184 facilitates guiding piston 158 therebetween such that piston 158 may be inserted into bolt 156 in a pre-determined orientation, as described in more detail below.

Bolt 156 may also include a plurality of bolt locking lugs 186 that each extend substantially radially away from bolt 156 at a second end of bolt 156, as shown in FIG. 2C. The second end of bolt 156 may also include a depression 188 defined therein, a bolt face 190 and a chamfer 192 defined within bolt 156. Piston passage 174 may be coupled in flow communication with depression 188 such that chamfer 192 extends between depression 188 and piston passage 174. Specifically, chamfer 192 may include a chamfer angle that is measured with respect to bolt centerline axis 172, wherein chamfer 192 enables primer 130 to clear bolt 156 as the spent casing 126 is ejected, as shown in FIG. 2D and as described in more detail below. In the exemplary embodiment, bolt 156 may also include an extractor 196 and an ejector 198. Extractor 196 may include a spring-loaded arm (not shown) coupled to bolt 156 and a lip 200 that facilitates hooking rim 127 of casing 126. Ejector 198 may include a spring-loaded member that is slidably coupled to bolt 156 and facilitates pivoting the spent casing 126 about extractor 196 and thus ejecting casing 126 from firearm 100.

FIGS. 3A, 3B, 3C, 3D and 3E represent various views of piston 158. FIGS. 3A, 3B and 3C are a side view, a top view and a bottom view of piston 158, respectively. FIG. 3D is an axial end view of piston 158 taken along line D-D. FIG. 3E is an axial end view of piston 158 taken along line E-E. FIG. 4 is a side view of firing pin 162. In the exemplary embodiment, piston 158 may include an end stop 202, a tip portion 204 and a body portion 206 extending therebetween. Moreover, piston 158 may be substantially cylindrically-shaped and include a piston centerline axis 208, which is substantially coaxial with firearm centerline axis 112. Further, piston 158 may include a firing pin passage 210 defined therein that extends substantially the axial length of piston 158. Specifically, in the exemplary embodiment, firing pin passage 210 is sized and shaped to house firing pin 162 therein, such that firing pin 162 is slidably coupled to piston 158. Tip portion 204 may include a tip face 212 that may be sized and aligned to substantially contact primer 130. As a result, primer 130 may contact tip face 212 without contacting bolt face 190.

Piston body portion 206 may include a recess 214 and an elongated slot 216 that are each defined within piston 158, and more specifically, piston body portion 206. Recess 214 may be substantially circular-shaped and extend at least partially through piston body portion 206 towards firing pin passage 210. Specifically, recess 214 is sized and shaped to receive at least a portion of cam pin 160, as described in more detail below. Elongated slot 216 may be positioned adjacent recess 214 such that elongated slot 216 extends perpendicularly away from recess 214 and through piston body portion 206. Moreover, elongated slot 216 may include an axial length (not shown) that is oriented substantially parallel to firing pin passage 210, and more specifically, piston centerline axis 208. Specifically, elongated slot 216 is configured to receive at least a portion of cam pin 160 to facilitate coupling cam pin 160 to piston 158, as described in more detail below. More specifically, a gap 218 may be defined between a slot wall of piston 158 and cam pin 160, as shown in FIG. 1.

End stop 202 may include a flange 182 that extends substantially radially away from an outer surface of piston body portion 206. End stop 202 may also include a pair of angled outer surfaces 222 that are each oriented at a second angle that is substantially equal to the first angle of inner surface 184 of each flange 182. As a result, piston 158 may be inserted within bolt 156 in a pre-determined orientation with respect to bolt 156, which facilitates decreasing the assembly time of firearm 100, and more specifically, bolt assembly 136.

FIGS. 5A and 5B represent various views of cam pin 160. FIG. 5A is an end view of cam pin 160. FIG. 5B is a side view of cam pin 160. In the exemplary embodiment, cam pin 160 includes a substantially cylindrical-shaped body portion 224 and a substantially rectangular-shaped extension portion 226 that extends away from body portion 224. Extension portion 226 includes a passage 228 defined therein that extends axially therethrough, wherein passage 228 is configured to receive firing pin 162. Moreover, extension portion 226 may also include at least one anchor member 230 that extends away from extension portion 226 to facilitate slidably coupling cam pin 160 to bolt 156 such that anchor member 230 is positioned within second aperture 180, as described in more detail below.

Figure 6B:
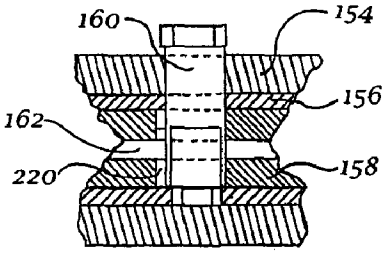
FIG. 6B is a cross-sectional side view of the bolt assembly shown in FIG. 6A.
Figure 6A:
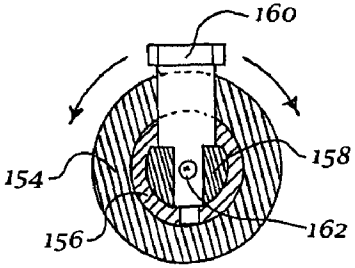
FIG. 6A is a cross-sectional axial view of a bolt assembly that may be used in the firearm shown in FIG. 1.
Figure 7:
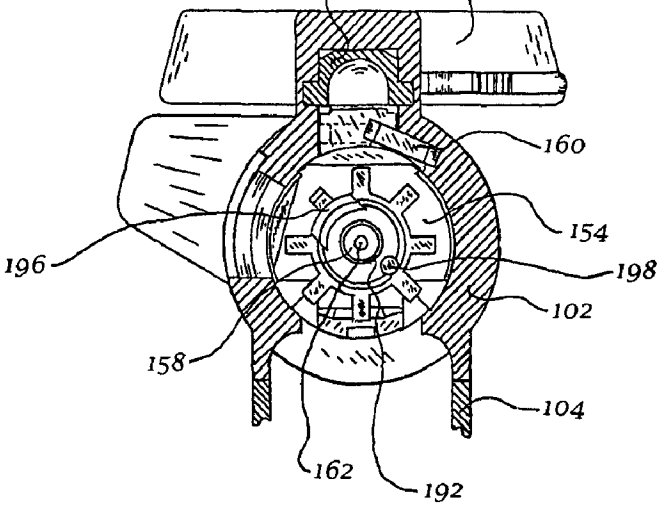
FIG. 7 is a cross-sectional axial view of the firearm shown in FIG. 1.

In the exemplary embodiment, piston 158 may be inserted into bolt 156, and more specifically, piston passage 174. End stop 202 and flanges 182 facilitate aligning piston 158 in a specific orientation with respect to bolt 156. Once piston 158 is inserted within bolt 156, the bolt 156 may be inserted into bolt carrier 154 such that at least a portion of cammed slot 168 is substantially aligned with first aperture 178 of bolt 156. Next, cam pin 160 may be inserted through cammed slot 168, and more specifically, through first aperture 178, recess 214, elongated slot 216 and second aperture 180, as shown in FIGS. 6A and 6B. Specifically, FIG. 6A is a cross-sectional axial view of bolt assembly 136. FIG. 6B is a cross-sectional side view of bolt assembly 136. In the exemplary embodiment, recess 214 may be sized and shaped to receive at least a portion of cam pin 160, and more specifically, body portion 224. Moreover, elongated slot 216 facilitates aligning extension portion 226 of cam pin 160 with respect to piston 158. In the exemplary embodiment, elongated slot 216 may be sized to be between about 0.030 inches to about 0.050 inches longer than extension portion 226 such that gap 218 extends axially between about 0.030 inches to about 0.050 inches. More specifically, elongated slot 216 may be sized to be about 0.040 inches longer than extension portion 226 such that gap 218 extends axially about 0.040 inches. In alternative embodiments of center-fire cartridge firearms 100, the caliber of the center-fire cartridge used within firearm 100 may differ compared to the center-fire cartridge 122 in the exemplary embodiment. As a result, in such alternative embodiments, elongated slot 216 may be sized to any length that enables firearm 100 to function as described herein.

Specifically, extension portion 226 enables cam pin 160 to be inserted in a specific orientation with respect to elongated slot 216. In the exemplary embodiment, extension portion 226 may be inserted into elongated slot 216 at 0° or at 180° with respect to piston centerline axis 208. As a result, extension portion 226 and elongated slot 216 facilitate increasing the speed at which a user may assemble firearm 100. Once the cam pin 160 is inserted within bolt assembly 136, firing pin 162 may be inserted through firing pin passage 210 of piston 158 and passage 228 of cam pin 160. Once firing pin 162 is inserted into bolt assembly 136, the bolt assembly 136 may be inserted into cavity 110 of upper receiver 102 to form firearm 100, as shown in FIG. 6.

Bolt assembly 136 may be positioned within cavity 110 such that bolt assembly 136 is slidably coupled to upper receiver 102. Moreover, a charger 234 may also be positioned within cavity 110 such that charger 234 is coupled to bolt carrier 154. In the exemplary embodiment, charger 234 includes a charger handle 236 and enables a user to slide bolt assembly 136 rearward away from barrel 116 to facilitate loading chamber 120 with cartridge 122.

During operation of firearm 100, the user may load cartridge 122 into chamber 120 by pulling charger 234 rearward, away from barrel 116, using charger handle 236. Rearward movement of charger 234 facilitates sliding bolt assembly 136 rearward such that chamber 120 is opened and a new cartridge 122 from a magazine (not shown) may be inserted into cavity 110 of upper receiver 102. Once cartridge 122 is positioned within cavity 110, the user may release a bolt assembly lock (not shown) which enables buffer assembly 146 to slide bolt assembly 136, and more specifically cartridge 122 towards chamber 120. As a result, cartridge 122 is inserted into chamber 120 and coupled to bolt 156 using extractor 196. Moreover, as bolt assembly 136 slides towards barrel 116, bolt locking lugs 186 of bolt 156 pass barrel locking lugs 124 in a meshing manner such that bolt locking lugs 186 extends axially into barrel 116 a distance beyond barrel locking lugs 124. The force the buffer assembly 146 applies to bolt assembly 136 facilitates compacting the multiple components of bolt assembly 136. Moreover, cammed slot 168 of bolt carrier 154 is compressed towards cam pin 160 such that cam pin body portion 224 contacts the cammed portion of cammed slot 168. As a result, cam pin 160 slides along cammed portion 170 of cammed slot 168, which facilitates rotating bolt 156, piston 158 and bolt locking lugs 186 about 22.5° about bolt centerline axis 172. As such, bolt locking lugs 186 rotate about 22.5° about bolt centerline axis 172, which enables bolt locking lugs 186 to overlap and contact barrel locking lugs 124, which facilitates locking bolt assembly 136 to barrel 116. In an alternative embodiment, cammed slot may rotate bolt 156 any number of degrees that enables firearm 100 to function as described herein.

In the exemplary embodiment, buffer assembly 146 facilitates compressing bolt assembly 136, and more specifically piston 158, within bolt 156 such that tip face 212 is positioned adjacent primer 130, as shown in FIG. 1. Specifically, vent hole 171 facilitates channeling air out of bolt passage 163 as piston 158 is compressed against bolt carrier 154 by buffer assembly 146. Gap 218 is formed between a forward surface of cam pin extension portion 226 and a wall of elongated slot 216 in piston 158, as shown in FIG. 1. In the exemplary embodiment, gap 218 facilitates limiting the rearward travel of piston 158, which facilitates limiting the rearward travel of primer 130. Moreover, vent hole 171 facilitates channeling air into bolt passage 163 as bolt carrier 154 slides rearward away from piston 158 to facilitate preventing the formation of a vacuum between piston 158 and bolt carrier 154.

In the event the user pulls the trigger of firearm 100, hammer 138 pivots about pivot pin 140 such that hammer 138 strikes firing pin 162, which facilitates pushing the tip of firing pin 162 into primer 130. As a result, the explosive material contained within cartridge 122 is ignited. In the exemplary embodiment, firing pin 162 penetrates primer 130 about 0.032 inches to facilitate igniting the explosive material contained within cartridge 122. In another embodiment, firing pin 162 may penetrate primer 130 at any length that enables firearm 100 to function as described herein. As a result, an explosion occurs within cartridge 122 which facilitates propelling projectile 128 forward along firearm centerline axis 112 and through rifle bore 118. In the exemplary embodiment, projectile 128 is propelled out of rifle bore 118 at a speed in excess of 3000 feet per second ("fps").

Figure 8:
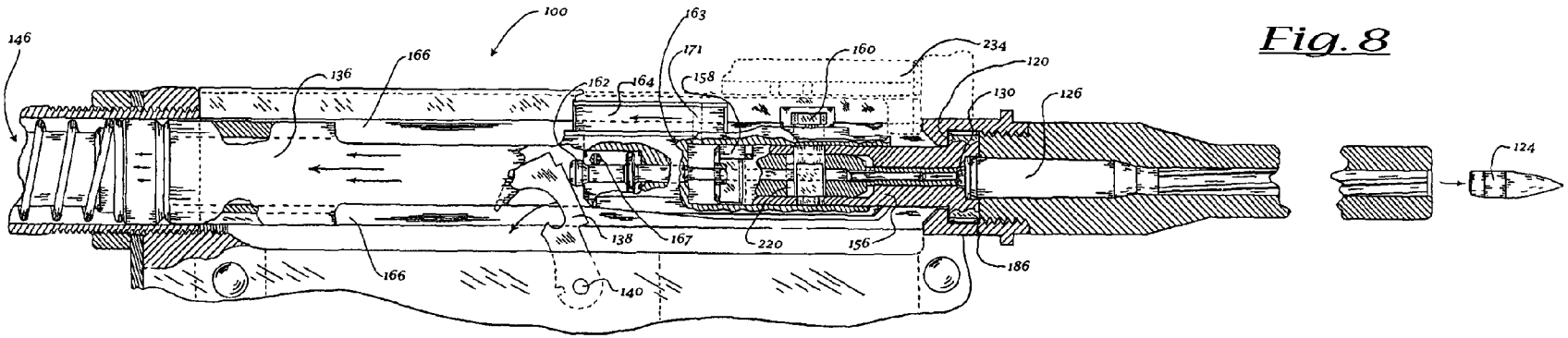
FIG. 8 is a cross-section side view of the firearm shown in FIG. 1.
Figure 9:
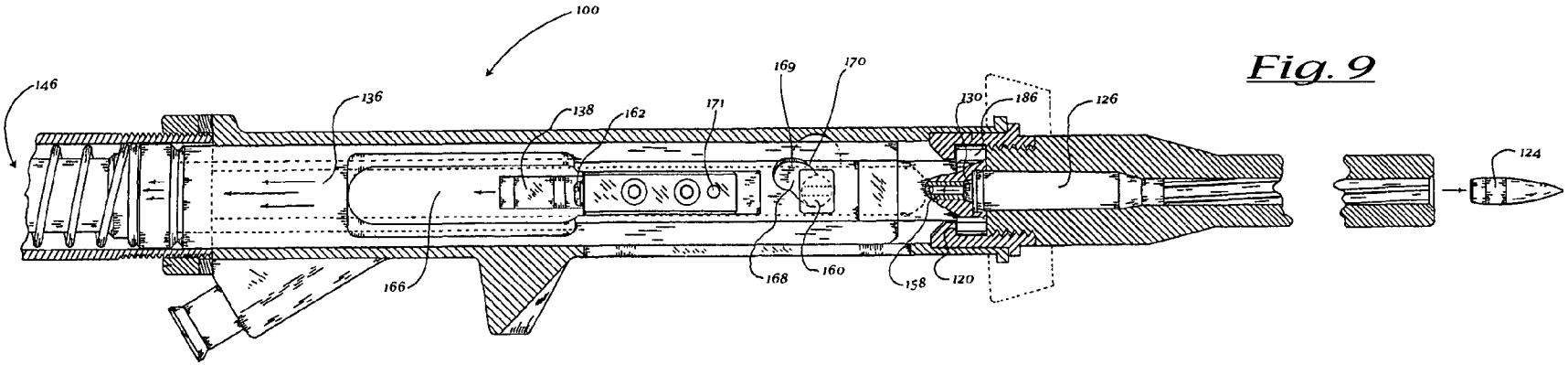
FIG. 9 is a cross-sectional top view of the firearm shown in FIG. 1.

In the exemplary embodiment, the explosion facilitates propelling primer 130 rearward along firearm centerline axis 112 about 0.040 inches, as shown in FIGS. 8 and 9. As described about, gap 218 limits the rearward travel of primer 130 to about 0.040 inches. Specifically, primer 130 actuates bolt assembly 136, and more specifically piston 158, by applying between about 1000 pounds per square inch ("psi") to about 1400 psi to tip face 212. In alternative embodiments of center-fire cartridge firearms 100, the caliber of the center-fire cartridge used within firearm 100 may differ compared to the center-fire cartridge 122 in the exemplary embodiment. As a result, in such alternative embodiments, primer 130 may apply any amount of force on tip face 212 that enables firearm 100 to function as described herein. In the exemplary embodiment, piston 158 travels rearward the length of gap 218 before contacting cam pin 160. As a result, a second gap 220 is formed between a rearward wall of elongated slot 216 and the side of cam pin 160, as shown in FIGS. 8 and 9. This rearward force applied to piston 158 is transferred to bolt carrier 154 which enables kinetic energy to build up within bolt carrier 154, which facilitates rearward movement of bolt carrier 154.

In the exemplary embodiment, bolt carrier 154 moves about 0.119 inches before cam pin 160 contacts cammed portion 170 of cammed slot 168. Specifically, non-cammed portion 169 enables bolt carrier 154 to move rearward about 0.119 inches before cam pin 160 contacts cammed portion 170. Alternatively, bolt carrier 154 may move rearward any length along non-cammed portion 169 that enables firearm 100 to function as described herein. Once cammed portion 170 contacts cam pin 160, cam pin 160 begins to slide along cammed portion 170, which facilitates rotating bolt 156 and piston 158 about bolt centerline axis 172 as bolt carrier 154 continues to move rearward. In the exemplary embodiment, bolt carrier 154 may then move rearward about 0.335 inches to facilitate rotating cam pin 160, and more specifically bolt 156, about 22.5° about bolt centerline axis 172, which facilitates unlocking bolt locking lugs 186 from barrel locking lugs 124. Alternatively, bolt carrier 154 may move rearward any length to unlock locking lugs 186 and to enable firearm 100 to function as described herein. As the cam pin 160 reaches the end of cammed slot 168, bolt 156 is in the unlocked position and cam pin 160 engages bolt carrier 154 such that bolt carrier 154 facilitates moving bolt 156 rearward. The rearward movement of bolt assembly 136 facilitates compressing buffer assembly 146 and facilitates opening chamber 120. Once chamber 120 begins to open, or breach, projectile 128 has already left rifle bore 118. As a result, the pressure within rifle bore 118 that was generated by the explosion of cartridge 122 is dissipated. As such, the propellant gas, and more specifically, the residue is not forced back into cavity 110 of upper receiver 102. As a result, bolt assembly 136 facilitates preventing fouling of cavity 110, and more specifically, bolt assembly 136.

In the exemplary embodiment, the rearward movement of bolt assembly 136 facilitates moving spent casing 126 rearward and out of chamber 120. Specifically, rim 127 of casing 126 is coupled to bolt 156 using lip 200 of extractor 196. Once chamber 120 is completely opened, the force applied to casing 126 by spring-loaded ejector 198 facilitates pivoting casing 126 about lip 200 and ejecting casing 126 out of cavity 110. Once the spent casing 126 has been ejected, a new cartridge is loaded into cavity 110. Buffer assembly 146 facilitates sliding bolt assembly 136 forward towards barrel 116 once the rearward movement of bolt assembly 136 has stopped. Once bolt assembly 136, and more specifically, bolt 156 is locked within barrel 116, firearm 100 is ready to fire again.

In the exemplary embodiment, primer 130 facilitates actuating bolt assembly 136, which facilitates moving bolt assembly 136 rearward and enables the ejection and reloading of cartridges 122. Moreover, the actuation of bolt assembly 136 by primer 130 facilitates eliminating blowback and gas-operation autoloading methods of firearms that utilize centerfire cartridges. As a result, primer actuation facilitates preventing the fouling of firearm components which facilitates reducing misfires and gun jams due to residue buildup.

The foregoing description and accompanying figures illustrate the principles, preferred embodiments and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. A method of assembling a firearm, said method comprising:

providing a bolt assembly that includes a bolt carrier that includes a cammed slot and a first passage, a bolt member slidably coupled to the bolt carrier and positioned within the first passage, the bolt member includes at least one aperture and a second passage, a piston member slidably coupled to the bolt member and positioned within the second passage, the piston member includes an elongated slot and a third passage, wherein the elongated slot includes a first length, and a cam pin slidably coupled to at least one of the bolt carrier, the bolt member and the piston member, the cam pin includes a fourth passage; and coupling the bolt assembly within a cavity of the firearm such that the bolt assembly is slidably coupled to an upper receiver of the firearm.

2. A method in accordance with claim 1 further comprising coupling a firing pin within at least one of the third passage and the fourth passage, such that the firing pin is slidably coupled to at least one of the piston member and the cam pin.

3. A method in accordance with claim 1 further comprising providing a bolt member that includes a first end that includes at least one flange extending axially away therefrom, wherein the at least one flange includes at least one inner surface oriented at a first angle, a second end that includes a depression defined therein, a plurality of locking lugs extending radially away from the second end, and a chamfer defined within said bolt member that extends between the second passage and the depression.

4. A method in accordance with claim 3 further comprising providing a piston member that includes a tip portion that includes a tip face and an end stop that includes at least one sidewall oriented at a second angle that is substantially identical to said first angle of said at least one flange.

5. A method in accordance with claim 4 further comprising coupling the bolt assembly within the cavity of the firearm such that the tip face of the piston member is positioned adjacent a cartridge primer such that the cartridge primer facilitates actuating the bolt assembly during ignition of a cartridge.

6. A method in accordance with claim 1 further comprising providing a cam pin that includes a substantially cylindrical-shaped body portion and an extension portion that extends away therefrom, wherein the extension portion includes a second length that is substantially shorter than the first length of the elongated slot such that a gap is defined between the extension portion and a wall of the elongated slot.

7. A bolt assembly comprising:

a bolt carrier that comprises a cammed slot and a first passage;

a bolt member slidably coupled to said bolt carrier and positioned within said first passage, said bolt member comprises at least one aperture and a second passage;

a piston member slidably coupled to said bolt member and positioned within said second passage, said piston member comprises a third passage and an elongated slot that comprises a first length; and a cam pin slidably coupled to at least one of said bolt carrier, said bolt member and said piston member, said cam pin comprising a fourth passage.

8. A bolt assembly in accordance with claim 7 further comprising a firing pin coupled within at least one of said third passage and said fourth passage, such that said firing pin is slidably coupled to at least one of said piston member and said cam pin.

9. A bolt assembly in accordance with claim 7, said bolt member further comprises:

a first end comprising at least one flange extending axially away therefrom, said at least one flange comprises at least one inner surface oriented at a first angle;

a second end comprising a depression defined therein, a plurality of locking lugs extending radially away from said second end, and a chamfer defined within said bolt member that extends between said second passage and said depression; and a body portion extending between said first end and said second end.

10. A bolt assembly in accordance with claim 9, said piston member further comprises:

an end stop comprising at least one sidewall oriented at a second angle that is substantially identical to said first angle of said at least one flange to facilitate orientating said piston member with respect to said bolt member;

a tip portion comprising a tip face that facilitates contacting a primer of a cartridge; and a body portion extending between said end stop and said tip portion.

11. A bolt assembly in accordance with claim 7, said cam pin further comprises a substantially cylindrical-shaped body portion and an extension portion extending away therefrom, said extension portion comprising a second length that is substantially shorter than said first length of said elongated slot.

12. A bolt assembly in accordance with claim 11 further comprising a gap defined between said extension portion and a wall of said elongated slot.

13. A bolt assembly in accordance with claim 7 further comprising a means for actuating said bolt assembly.

14. A firearm comprising:

an upper receiver comprising a cavity defined therein;

a barrel coupled to said upper receiver;

a lower receiver coupled to said upper receiver; and a bolt assembly slidably coupled to upper receiver and positioned within said cavity, said bolt assembly comprising:

a bolt carrier that comprises a cammed slot and a first passage;

a bolt member slidably coupled to said bolt carrier and positioned within said first passage, said bolt member comprises at least one aperture and a second passage;

a piston member slidably coupled to said bolt member and positioned within said second passage, said piston member comprises a third passage and an elongated slot that comprises a first length; and a cam pin slidably coupled to at least one of said bolt carrier, said bolt member and said piston member, said cam pin comprising a fourth passage.

15. A firearm in accordance with claim 14 further comprising a firing pin coupled within at least one of said third passage and said fourth passage, such that said firing pin is slidably coupled to at least one of said piston member and said cam pin.

16. A firearm in accordance with claim 14, said bolt member further comprises:

a first end comprising at least one flange extending axially away therefrom, said at least one flange comprises at least one inner surface oriented at a first angle;

a second end comprising a depression defined therein, a plurality of locking lugs extending radially away from said second end, and a chamfer defined within said bolt member that extends between said second passage and said depression; and a body portion extending between said first end and said second end.

17. A firearm in accordance with claim 16, said piston member further comprises:

an end stop comprising at least one sidewall oriented at a second angle that is substantially identical to said first angle of said at least one flange to facilitate orientating said piston member with respect to said bolt member;

a tip portion comprising a tip face that facilitates contacting a primer of a cartridge; and a body portion extending between said end stop and said tip portion.

18. A firearm in accordance with claim 14, said cam pin further comprises a substantially cylindrical-shaped body portion and an extension portion extending away therefrom, said extension portion comprising a second length that is substantially shorter than said first length of said elongated slot.

19. A firearm in accordance with claim 18 further comprising a gap defined between said extension portion and a wall of said elongated slot.

20. A firearm in accordance with claim 14 further comprising a means for actuating said bolt assembly.

* * * * *